US006526696B2

(12) United States Patent
Cardine

(10) Patent No.: US 6,526,696 B2
(45) Date of Patent: Mar. 4, 2003

(54) WINDOW REGULATOR, PARTICULARLY FOR A VEHICLE QUARTER PANEL

(75) Inventor: Patrice Cardine, Orleans (FR)

(73) Assignee: Meritor Light Vehicle Systems (France), Sully-sur-Loire (FR)

( * ) Notice: Subject to any disclaimer, the term of this patent is extended or adjusted under 35 U.S.C. 154(b) by 0 days.

(21) Appl. No.: 10/001,754

(22) Filed: Oct. 23, 2001

(65) Prior Publication Data

US 2002/0046498 A1 Apr. 25, 2002

(30) Foreign Application Priority Data

Oct. 24, 2000 (FR) ..... 00 13601

(51) Int. Cl.[7] ..... E05F 11/52
(52) U.S. Cl. ..... 49/227; 49/352
(58) Field of Search ..... 49/213, 214, 226, 49/227, 502, 348, 349, 352

(56) References Cited

U.S. PATENT DOCUMENTS 3,646,707 A * 3/1972 Lystad ..... 49/227
4,615,143 A * 10/1986 Isetani ..... 49/374
4,633,613 A 1/1987 Kobayashi et al.
4,877,287 A * 10/1989 Escaravage ..... 297/417

FOREIGN PATENT DOCUMENTS

DE 199 43 338 A 3/2000

OTHER PUBLICATIONS

French Search Report dated Jul. 10, 2001.

* cited by examiner

*Primary Examiner*—Jerry Redman
(74) *Attorney, Agent, or Firm*—Carlson, Gaskey & Olds

(57) ABSTRACT

The invention relates to a window regulator of an automobile vehicle quarter panel, which comprises a support plate having two cam grooves substantially offset in an oblique direction, a mobile carrier supporting a windowpane guided by the cam grooves, a cable winding drum connected to the mobile carrier by an upper cable passing over an upper return pulley and by a lower cable passing over a lower return pulley. The lower return pulley is arranged in height between the height of the lower ends of the two cam grooves. This allows the total height of the support plate to be decreased.

16 Claims, 4 Drawing Sheets

WINDOW REGULATOR, PARTICULARLY FOR A VEHICLE QUARTER PANEL

BACKGROUND OF THE INVENTION

The present invention relates to the domain of window regulators for automobile vehicles.

A prior art automobile vehicle window regulator comprises a vertical support plate in which two substantially vertical cam grooves are formed, namely an upper cam groove and a lower cam groove which essentially depend on each other through an oblique translation with respect to the horizontal so that the upper and lower ends of the lower cam groove are located at heights lower than those of the corresponding ends of the upper cam groove, a mobile carrier supporting a windowpane and mounted on said support plate by means of guiding means cooperating with said cam grooves in order to impart to the pane a movement of translation and possibly of rotation about a transverse axis with respect to said support plate as a function of the contours of said cam grooves, a cable winding drum connected to said mobile carrier by an upper cable passing over a first cable return means provided at the upper end of said support plate and by a lower cable passing over a second cable return means provided at the lower end of said support plate, and means for driving said winding drum.

Window regulators of this type are used for imparting a complex movement to the windowpane. It may for example be question of a window regulator for a quarter panel of a convertible, which is arranged in that part of the bodywork adjacent the passage of the wheels.

The drawback of this type of window regulator is that its space requirement is relative large. In effect, it is much larger than the travel of the windowpane, and this due to problems of implantation in the bodywork of the vehicles, particularly in the vicinity of the passages of wheels.

SUMMARY OF THE INVENTION

On the basis of this state of the art, the object of the present invention is to propose a window regulator whose space requirement in height is reduced.

The invention attains its object in that the first cable return means is located at a height included between the heights of the upper ends of the two cam grooves, and the second cable return means is located at a height included between the heights of the lower ends of the two cam grooves. The first cable return means is advantageously located above the upper end of the lower cam groove. More advantageously still, the second cable return means is located below the lower end of the upper cam groove. The means for guiding the mobile carrier preferably comprise two sliders respectively cooperating with a cam groove. Preferably, the upper cable is connected to the slider a cooperating with the lower cam groove and the lower cable is connected to the slider cooperating with the upper cam groove.

BRIEF DESCRIPTION OF THE DRAWINGS

The invention will be more readily understood on reading the following description given by way of example and with reference to the accompanying drawings, in which.

DESCRIPTION OF PREFERRED EMBODIMENT

Figure 1:
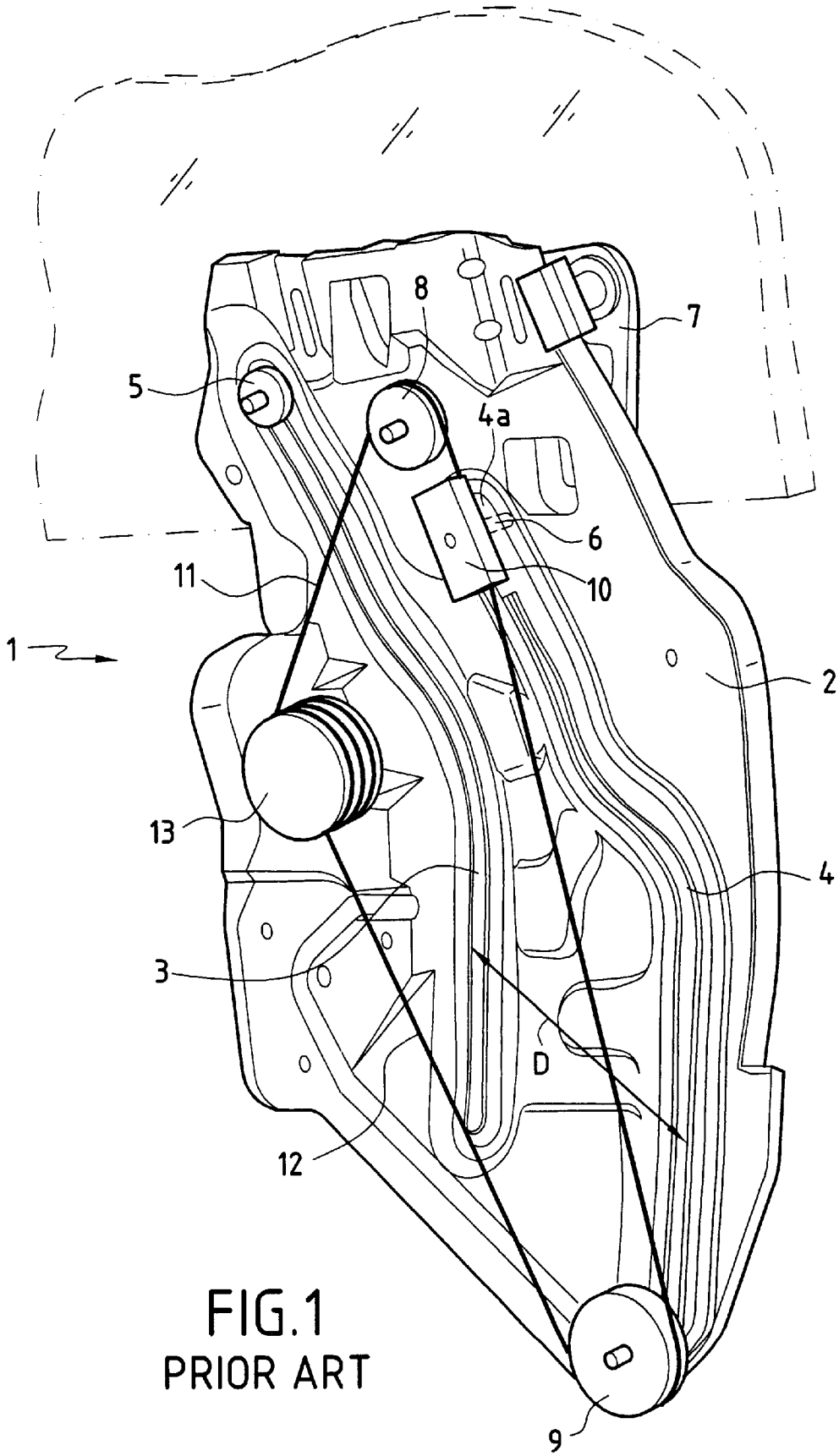
FIG.1 PRIOR ART
FIG. 1 is a view of the outer face of a window regulator according to the state of the art.
Figure 2:
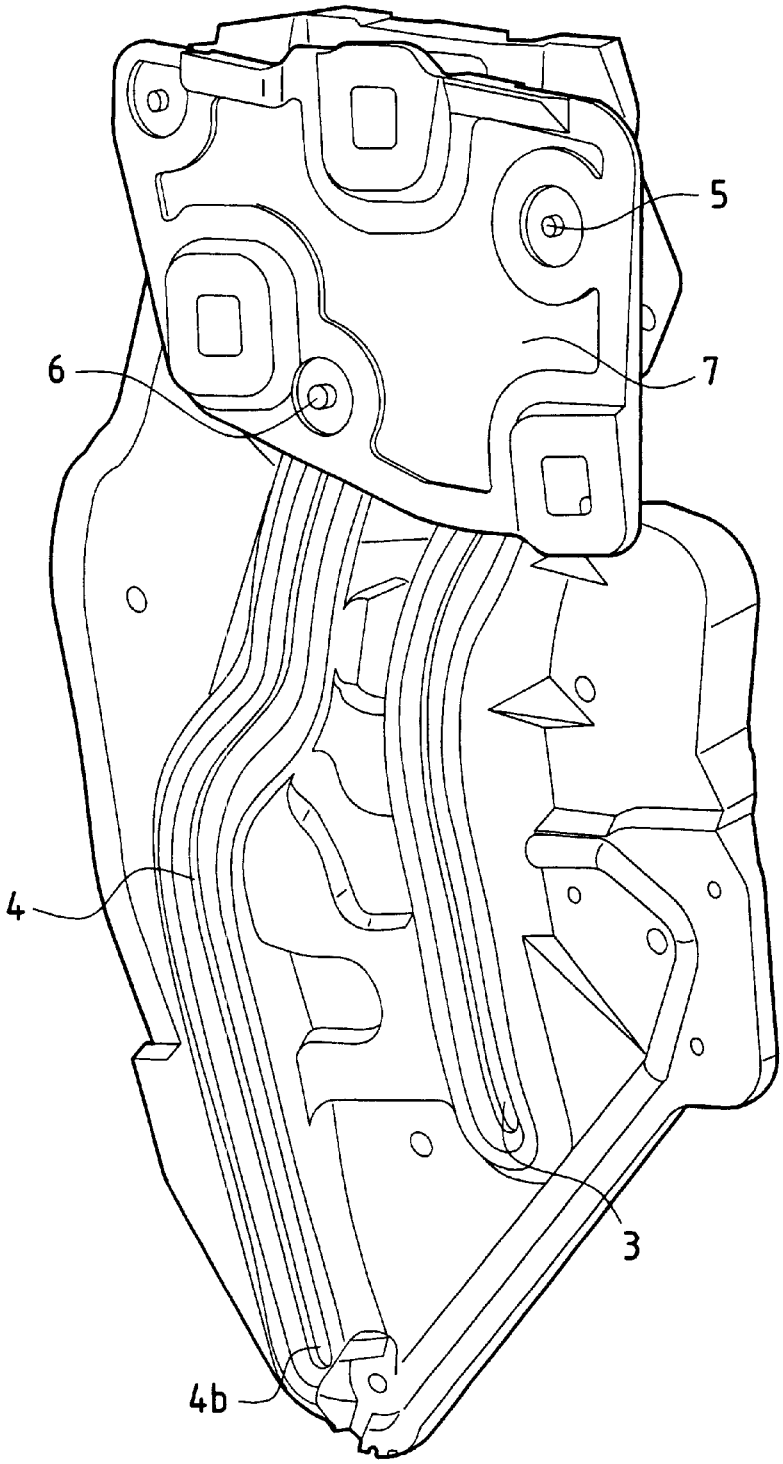
FIG.2 PRIOR ART
FIG. 2 is a view of the other face of the window regulator of FIG. 1.

FIGS. 1 and 2 of the accompanying drawings show the prior art arrangement of a known window regulator 1 on a support plate 2 which will subsequently be fixed on the bodywork.

Reference numeral 3 denotes the upper cam groove and reference numeral 4 denotes the lower cam groove. The designs of these two cam grooves 3 and 4 are substantially equal and they depend on each other through a translation in an oblique direction with respect to the horizontal, represented by arrow D. Rollers 5 and 6 slide respectively in the cam grooves 3 and 4. These rollers 5 and 6 are fast with a mobile carrier 7 visible in FIG. 2.

A first cable return 8 is arranged above the upper end 4*a* of the lower cam groove 4. The second cable return 9 is arranged below the lower end 4*b* of the lower cam groove 4. On the roller 6 is fixed a slider 10 which serves as anchor for the ends of two cables, namely an upper cable 11 which passes via the first cable return 8 and joins a winding drum 13, and a lower cable 12 which passes via the second cable return 9 and joins the winding drum 13. The winding drum 13 is driven in rotation by a drive system, for example a crank, or an electric motor (not shown in the drawings).

When the winding drum 13 is driven in rotation, one of the cables 11 or 12 winds on the drum and the other cable 12 or 11 unwinds from the drum. The winding drum 13 is mounted on the support plate 2. Rotation of the winding drum 13 thus brings about displacement of the slider 10 and consequently the lifting or lowering of the carrier 7 and of the windowpane 26 borne by this carrier 7. As the cam grooves 3 and 4 are not strictly parallel, the windowpane 26 is subjected to a translation and possibly a rotation about a transverse axis. The vertical offset between the upper ends 3*a*, 4*a* or lower ends 3*b*, 4*b* of the cam grooves 3 and 4 is substantially equal to 10 cm.

Figure 3:
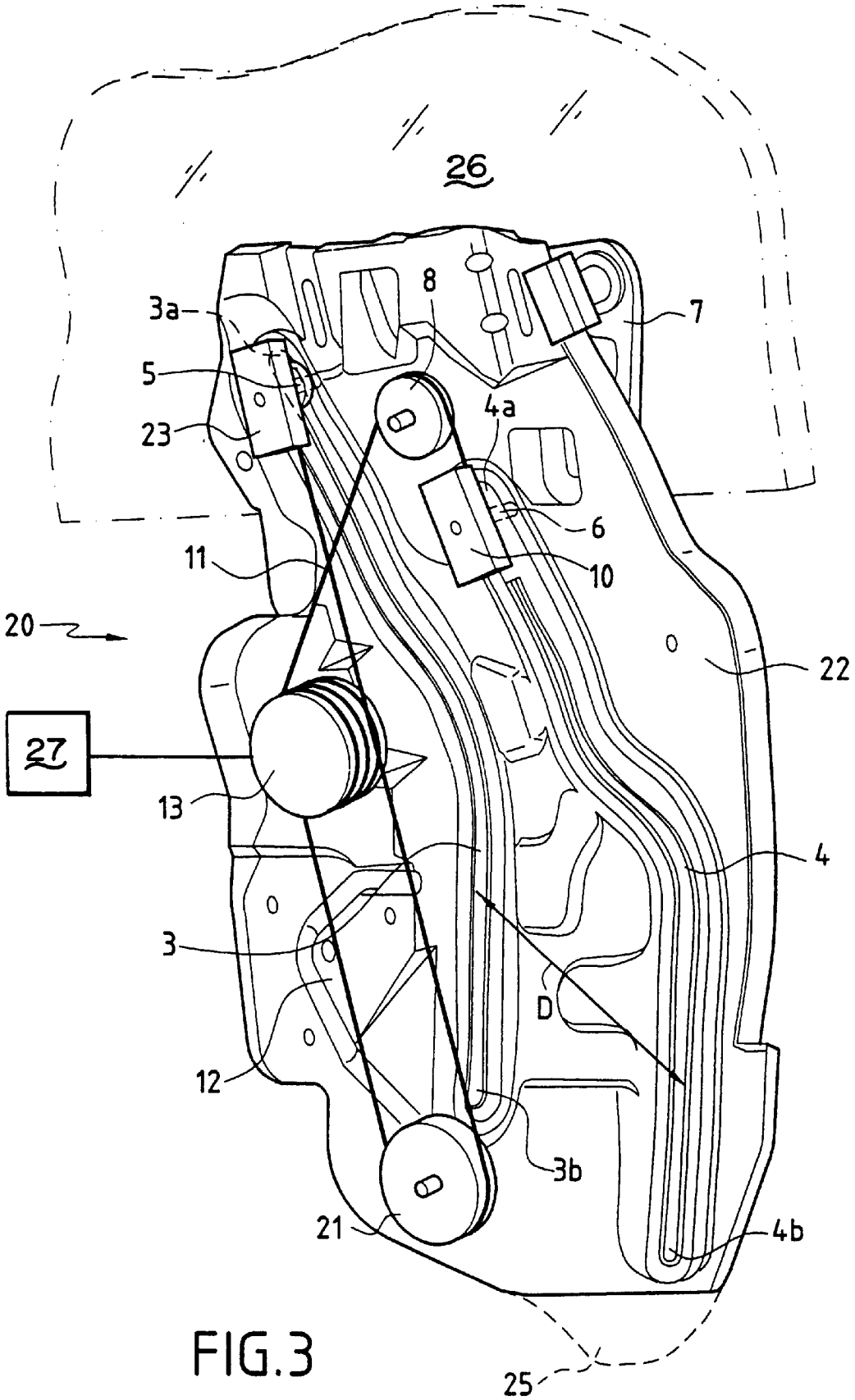
FIG. 3 is a view of the inner face of a window regulator according to the invention.

FIG. 3 shows the inner face of a window regulator 20 according to the invention in which elements identical to those of the prior art bear the same references. This window regulator 20 comprises a support plate 22 intended to be fixed on the bodywork of a vehicle, which presents an upper cam groove 3 and a lower cam groove 4 which essentially depend on each other through a translation in the direction of arrow D oblique with respect to the horizontal. Rollers 5 and 6 borne by a mobile carrier 7 slide respectively in the cam grooves 3 and 4. A first slider 10 is fixed on the roller 6 and a second slider 23 is fixed on the roller 5.

A first cable return device 8 is provided on the support plate 22 above the upper end 4*a* of the lower cam groove 4. A second cable return device 21 is provided on the support plate 22 in the vicinity of the lower end 3*b* of the upper cam groove 3. The support plate 22 further supports a drum 13 for winding an upper cable 11 and a lower cable 12 driven by a drive system 27. The upper cable 11 connects the first slider 10 to the winding drum 13, passing over the upper return device 8. The lower cable 12 connects the second slider 23 to the winding drum 13, passing beneath the lower return device 21.

It should be noted that the cable return devices 8 and 21 may advantageously be return pulleys arranged so that the side of the upper cable which connects the pulley 8 to the drum 13 cannot hinder the displacement of the second slider 23. The rollers 5 and 6 may be constituted by rings mounted on pins fast with the support plate 7 and sliders 10 and 23.

Compared to the state of the art illustrated in FIG. 1, it is observed that, according to the invention, the lower cable return device 21 is located in the vertical direction between the height of the lower end 3*b* of the upper cam groove 3 and the lower end 4*b* of the lower cam groove 4. In this way, the lower end 25 of the support plate 1 of the prior art, located below the lower end 4*b* of the lower cam groove 3 and shown in dotted lines in FIG. 3, may be eliminated thanks to the invention.

Figure 4:
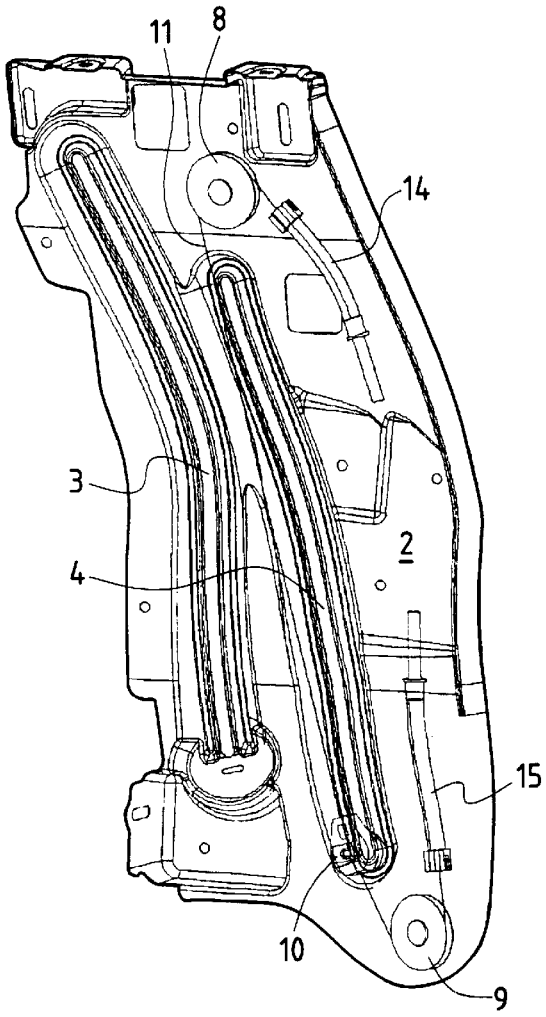
FIG.4 PRIOR ART
FIGS. 4 and 5 show the same type of window regulator respectively according to the state of the art and according to the invention.

FIG. 4 shows a second known window regulator which differs from that of FIG. 1 by the general shape of the support plate 2, the designs of the cam grooves and the arrangement of the sides of the upper 11 and lower 12 cables respectively between the upper return pulley 8 and the lower return pulley 9, on the one hand, and the winding drum, not shown in FIG. 4, on the other hand. In this window regulator, these cable sides are arranged in sheaths.

Figure 5:
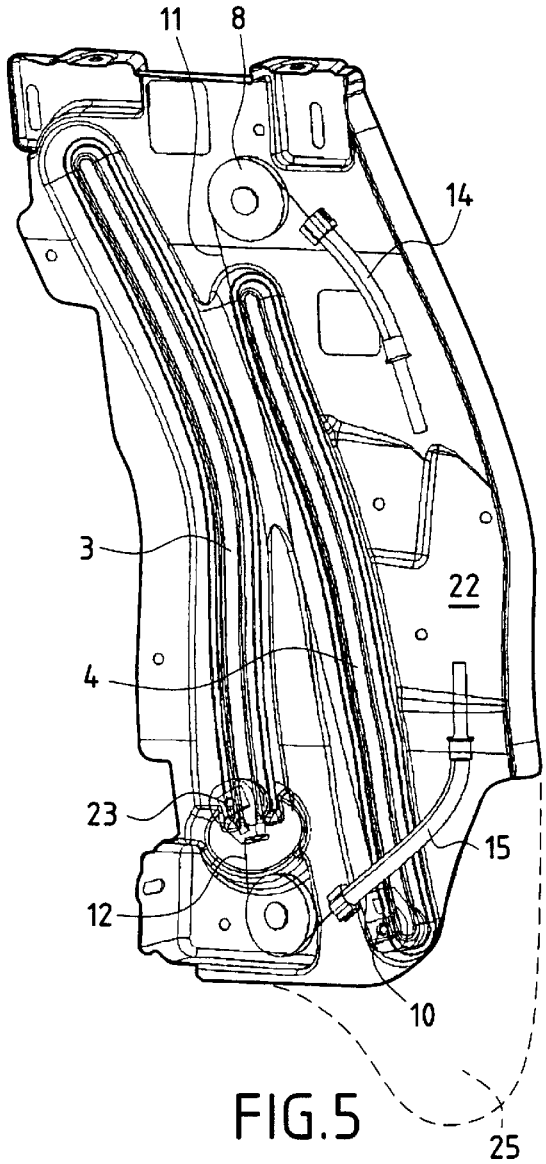

FIG. 5 shows the modification made to the window regulator of FIG. 4 in order to be in accordance with the invention. The lower cable return pulley 12 is arranged beneath the lower end 3*b* of the upper cam groove 3. Reference 25 shows the eliminated lower part of the support plate 2 to obtain the support plate 22 of the window regulator according to the invention.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. An automobile vehicle window regulator comprising:

a vertical support plate in which a pair of substantially vertical cam grooves including an upper cam groove and a lower cam groove are formed, an upper end and an lower end of the lower cam groove located at heights lower than the upper end and the lower end, respectively, of the upper cam groove;

a mobile carrier supporting a windowpane and mounted on said support plate by a guiding mechanism cooperating with said cam grooves to impart movement to the windowpane;

a cable winding drum connected to said mobile carrier by an upper cable passing over a first cable return mechanism provided at an upper end of said support plate located between the upper ends of the pair of cam grooves and by a lower cable passing over a second cable return mechanism provided at a lower end of said support plate located between the lower ends of the pair of cam grooves, said upper cable and said lower cable wound around said cable winding drum; and a drive system for driving said winding drum.

2. The window regulator of claim 1, wherein the first cable return mechanism is located above the upper end of the lower cam groove.

3. The window regulator of claim 1, wherein the second cable return mechanism is located below the lower end of the upper cam groove.

4. The window regulator of claim 1, wherein the guiding mechanism for guiding the mobile carrier includes an upper slider and a lower slider which each cooperate with one of said cam grooves.

5. The window regulator of claim 4, wherein the upper cable is connected to the lower slider which cooperates with the lower cam groove.

6. The window regulator of claim 4, wherein the lower cable is connected to the upper slider which cooperates with the upper cam groove.

7. The window regulator as recited in claim 1 wherein a first end of said upper cable is attached to said lower slider and a second end of said upper cable is attached to said cable winding drum, and a first end of said lower cable is attached to said upper slider and a second end of said lower cable is attached to said cable winding drum.

8. The window regulator as recited in claim 1 wherein said mobile carrier mounted on said support plate by said guide mechanism cooperates with said cam grooves to impart translation and rotation to said windowpane.

9. A windowpane assembly for a vehicle door comprising:

a windowpane; and a window regulator to cause movement of said window including a vertical support plate in which a pair of substantially vertical cam grooves including an upper cam groove and a lower cam groove are formed, an upper end and an lower end of the lower cam groove located at heights lower than the upper end and the lower end, respectively, of the upper cam groove, a mobile carrier supporting a windowpane and mounted on said support plate by a guiding mechanism cooperating with said cam grooves to impart movement to the windowpane, a cable winding drum connected to said mobile carrier by an upper cable passing over a fist cable return mechanism provided at an upper end of said support plate located between the upper ends of the pair of cam grooves and by a lower cable passing over a second cable return mechanism provided at a lower end of said support plate located between the lower ends of the pair of cam grooves, said upper cable and said lower cable wound around said cable winding drum, and a drive system for driving said winding drum.

10. The windowpane assembly of claim 9, wherein the first cable return mechanism is located above the upper end of the lower cam groove.

11. The windowpane assembly of claim 9, wherein the second cable return mechanism is located below the lower end of the upper cam groove.

12. The windowpane assembly of claim 9, wherein the guiding mechanism for guiding the mobile carrier includes an upper slider and a lower slider which each cooperate with one of said cam grooves.

13. The window assembly of claim 12, wherein the upper cable is connected to the lower slider which cooperates with the lower cam groove.

14. The windowpane assembly of claim 12, wherein the lower cable is connected to the upper slider which cooperates with the upper cam groove.

15. The windowpane assembly as recited in claim 9 wherein a first end of said upper cable is attached to said lower slider and a second end of said upper cable is attached to said cable winding drum, and a first end of said lower cable is attached to said upper slider and a second end of said lower cable is attached to said cable winding drum.

16. The windowpane assembly as recited in claim 9 wherein said mobile carrier mounted on said support plate by said guide mechanism cooperates with said cam groove to impart translation and rotation to said windowpane.

* * * * *

UNITED STATES PATENT AND TRADEMARK OFFICE

CERTIFICATE OF CORRECTION

PATENT NO. : 6,526,696 B2
DATED : March 4, 2003
INVENTOR(S) : Patrice Cardine

It is certified that error appears in the above-identified patent and that said Letters Patent is hereby corrected as shown below:

Column 3,
Line 42, “an” should be -- a --.

Column 4,
Line 23, “an” should be -- a --.
Line 30, “fist” should be -- first --.

Signed and Sealed this

Twenty-second Day of April, 2003

JAMES E. ROGAN
*Director of the United States Patent and Trademark Office*